US005269579A

United States Patent [19]

DeCrane

[11] Patent Number: 5,269,579

[45] Date of Patent: Dec. 14, 1993

[54] LIFTING ADAPTER FOR BULK BAGS

[76] Inventor: Charles E. DeCrane, 802 Janna St., West Monroe, La. 71291

[21] Appl. No.: 904,015

[22] Filed: Jun. 25, 1992

[51] Int. Cl.[5] ..... B66C 1/10

[52] U.S. Cl. ..... 294/81.56; 294/68.3; 294/75; 294/81.51

[58] Field of Search ..... 294/67.1, 67.3, 67.31, 294/68.1-68.21, 68.3, 74, 75, 81.1-81.56, 82.24, 82.3, 82.31; 141/114, 314; 248/99-101, 97; 383/6, 7, 13, 23, 33; 414/607, 608

[56] References Cited

U.S. PATENT DOCUMENTS

| | | | |
|---|---|---|---|
| 525,951 | 9/1894 | Flaniken | 294/75 |
| 1,036,225 | 8/1912 | Hall | 141/314 |
| 1,118,669 | 11/1914 | McPherson | 141/314 |
| 1,132,600 | 3/1915 | Moore | 141/314 |
| 1,576,660 | 3/1926 | Lassen | 248/100 |
| 1,796,288 | 3/1931 | Hester | 141/314 |
| 1,865,739 | 7/1932 | Bergmann | 294/81.5 |
| 1,918,007 | 7/1933 | Woodruff | 294/81.56 X |
| 2,423,325 | 7/1947 | Jones | 248/100 |
| 2,451,829 | 10/1948 | Hightower | 248/100 |
| 2,547,502 | 4/1951 | Smith et al. | 294/68.3 |
| 2,648,512 | 8/1953 | Scholin | 248/100 |
| 2,696,317 | 12/1954 | Toffolon | 294/74 X |
| 2,998,277 | 8/1961 | Himel | 294/75 |
| 3,039,808 | 6/1962 | Bouza | 294/68.3 X |
| 3,215,173 | 11/1965 | Rutherford | 141/83 |
| 3,972,553 | 8/1976 | Johnston | 294/81.5 X |
| 4,054,161 | 10/1977 | Alack | 141/12 |
| 4,182,386 | 1/1980 | Alack | 141/83 |
| 4,519,426 | 5/1985 | Hardy | 141/5 |
| 4,676,284 | 6/1987 | DeCrane | 141/114 |
| 4,688,371 | 8/1987 | Hecht | 141/83 X |
| 4,703,782 | 11/1987 | Henkel, Sr. | 141/114 X |
| 4,936,617 | 6/1990 | Greene et al. | 294/82.3 X |
| 5,036,893 | 8/1991 | DeCrane | 141/114 |

FOREIGN PATENT DOCUMENTS

| | | | |
|---|---|---|---|
| 1154606 | 9/1963 | Fed. Rep. of Germany | 294/81.56 |
| 8801616 | 1/1990 | Netherlands | 294/81.56 |
| 802164 | 2/1981 | U.S.S.R. | 294/81.2 |
| 919973 | 4/1982 | U.S.S.R. | 294/81.56 |
| 1502454 | 8/1989 | U.S.S.R. | 294/81.56 |
| 664624 | 10/1950 | United Kingdom | 141/313 |
| 645399 | 11/1950 | United Kingdom | 141/314 |

OTHER PUBLICATIONS

Misc Magazine & Advertising Pages on Bulk Shippers Taylor, Texcon, Darenth and Bulk-Pack Products (no date).

DE-STA-CO Products-Catalog Form 781 Misc Pages (1980).

Fax from De-STA-Company Dated Feb. 3, 1992, Sheet 1 Series 840, 860 etc. Clamps/Sheet 2 Drawing.

Mosier Industries, Inc.—Trans-Sair System—p. 3, Catalog Distributed by Hydragear, Inc.—Shreveport, La. (1987).

De-STA-CO Products, Fax dated Feb. 3, 1992 showing Series 840/860/890 and 1000 Toggle Power Clamp Specification and Drawing—DE-STA-Co Division of Dover Corp., 350 Midland Ave., Detroit, Mich. 48203.

*Primary Examiner*—Johnny D. Cherry

*Attorney, Agent, or Firm*—Noruell E. Von Behren

[57] ABSTRACT

A lifting adapter for use in lifting and releasing large bulk bags. The adapter has a frame formed in an X-shaped configuration in the preferred embodiment. The X-shaped frame is formed from tubular arms that extend downwardly and outwardly at an angle ranging from 10 to 30 degrees. Each arm holds a bag loop retaining toggle lock in the preferred embodiment which is pneumatically operated to serve to release the bag loops from the arms at a predetermined time so that the bag loops of the filled bag will slide off of the retaining toggle lock by gravity to thereby release the filled bag from the lifting adapter.

15 Claims, 3 Drawing Sheets

4

LIFTING ADAPTER FOR BULK BAGS

CROSS REFERENCE TO RELATED APPLICATIONS

U.S. Pat. No. 4,676,284, filed May 22, 1985 and issued Jun. 30, 1987 to Charles E. DeCrane and entitled "Bag Filling Machine With Releasable Supporting Arms".

U.S. Pat. No. 5,036,893, filed Mar. 23, 1990 and issued Aug. 6, 1991 to Charles E. De Crane and entitled "Bag Filling Machine With Traversing Latch Mechanism".

U.S. patent application, Ser. No. 07/692,693, filed Apr. 29, 1991 now U.S. Pat. No. 5,165,455 and entitled "Bag Filling Machine With Traversing Latch Mechanism".

BACKGROUND OF THE INVENTION

This invention relates generally to a lifting adapter for bulk bags and more specifically to a new and improved lifting adapter for use in lifting, moving and releasing large bulk bags in a storage position to a remote manufacturing location.

With the advent of large containers for the shipment of bulk materials from one location to another, there was introduced into this country approximately twenty to twenty five years ago, large square woven polypropylene bags for this purpose. These bulk bags had a capacity ranging from twenty cubic feet up to seventy cubic feet and would vary in size from thirty-five inches wide by thirty-five inches long by twenty-three inches high up to the same width and length bag having a height of eighty-two inches unfilled.

These bags were constructed with bag lifting loops on the top of the bag which were used for transporting the bags from one location to another. The lifting loops were also used for holding the bags while they were being filled in a filling machine. The bag lifting loops were generally constructed of a strong web-like material which was sewn onto the upper corners of the square bag.

With the introduction of these bags, bag filling machines were developed to fill these large bulk bags and to remove them from the filling machine. Since the filled bags weighed as much as two thousand pounds, the heavy bag had to drop from restraining devices that held the bag in the filling machine.

When the bag was filled, a portion of the two thousand pound weight was applied to the bag loops. This resulted in difficulty in getting the bag loop from the restraining device holding the bag in the machine. The bag loops would tend to hang upon the various rods or hooks used since many times the material being filled in the bag was a sticky material and the environment around the filling machine was one of a dust laden atmosphere containing the sticky material.

In FIGS. 1 and 2 of the drawings of the applicant's before described U.S. Pat. No. 4,676,284, there is shown several of the prior art bag filling machines shown holding the large bulky bags. In the same U.S. Pat. No. 4,676,284, there is shown in FIGS. 3–10 of the drawings and there is described in the patent, the applicant's unique solution to the problems using novel releasable supporting arm holding devices which were inclined towards the center of the bulk bag. This novel arm design served as the forerunner of later developed restraining devices that were often called bag loop latches in the trade.

The applicant's bag filling machine with releasable supporting arms or latches was very satisfactory for use in certain required situations and was well accepted commercially in the marketplace. The applicant's machine was originally designed with four fixed latches in each corner of the machine. This required a worker to lean into the machine from various positions to hang the bag loops on the latches. In the alternative, the worker would have to move around the machine to place the loops on the latches resulting in more time required to set up the machine for filling the bag.

It was also found that the applicant's bag filling machine was often placed in a crowded shop environment which did not easily give the worker access to moving around the machine and he would then have to lean into the machine to place the bag loops on the latches resulting in safety problems.

It was also discovered that many bag filling operations desired to use several sizes of bags which were not able to be handled by the applicant's original design. While this original unique bag machine had vertical provisions for variations in bag length, the fixed corner latch mechanisms of the filling machine permitted only one bag size in the horizontal periphery of the bag.

As a result, the applicant designed additional bag filling machines with new and improved bag loop latch constructions on his machines. These can be seen in the applicant's U.S. Pat. No. 5,036,893 before referenced and in his pending U.S. patent application Ser. No. 07/692,693. Reference should be made to these patents and applications as well as the prior art cited in those patents and applications for the various latch constructions used.

The large bulk bags that are filled with filling machines as designed by the applicant and others are then usually transported internally, in the manufacturing environment, to an internal storage site using various overhead cranes and/or fixed restraining adapter devices for use on the cranes. In many cases, the large filled bulk bags are stacked two-high in storage. This requires the second bag to be placed on top of the first stored bag at a distance of six to eight feet in the air.

When this occurs, the top of the second bag would be approximately ten to twelve feet above the ground. This large distance above the floor made a manual release from the lifting adapter for the top bag difficult. The bag loops on the crane or lifting adapter were too high to reach by a worker from the floor in order to unlatch the loop from the crane adapter. The distance of approximately ten to twelve feet for the top bag was also unsafe for a worker to reach since he had to crawl on top of the upper bag in order to be able to release the bag loops.

SUMMARY OF THE INVENTION

In order to overcome the problems inherent in this manner of removing the filled bag loops from the overhead crane or lifting adapter, there has been provided by the subject invention a new and novel lifting adapter for use in lifting and releasing large bulk bags from overhead cranes or lifting devices.

In the preferred embodiment given by way of illustration, the applicant's lifting adapter has a frame formed in an X-shape configuration with tubular arms that extend downwardly and outwardly at a predetermined angle. Each arm holds a bag loop retaining means which is pneumatically operated from a remote location to release the filled bag loops from the arms.

The predetermined angle of the arms serves to permit the bag loops to slide off of the retaining means by gravity when the retaining means are activated to a release position. As a result, the filled bulk bag may be easily stacked on top of another filled bag without requiring a worker to climb on top of the filled bags to release the bag loops.

Accordingly, it is an object and advantage of the invention to provide a bag lifting adapter that may be operated from a remote location to release a filled bag at a predetermined time as desired using a novel retaining means adapted to the lifting adapter.

Another object and advantage of the invention is to provide an improved lifting adapter that may be used with large bulk bag lifting loops to move and position the bag so that the lifting loops can be easily removed from the lifting adapter without subjecting workers to dangerous working conditions.

Another object and advantage of the subject invention is to provide a simple lifting frame construction that may be used with various retaining means to provide a novel lifting adapter.

These and other advantages and objects with become apparent from a study of the drawings of the invention and from a reading of the Description of the Preferred Embodiment which is given by way of illustration only and not as a limitation of the applicant's invention.

DESCRIPTION OF THE PREFERRED EMBODIMENT

Figure 1:
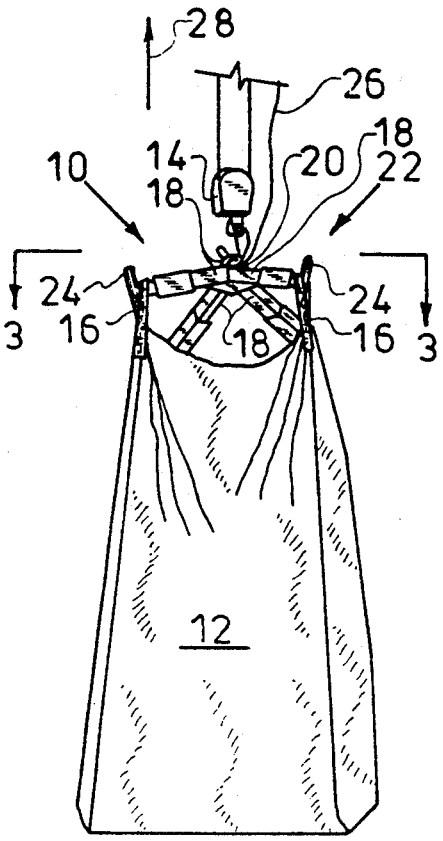
FIG. 1 is a perspective view of the applicant's novel lifting adapter being used to lift a large filled bulk bag by the lifting loops of the bag.

Referring now to the drawings in general and in particular to FIG. 1 of the drawings there is shown the Applicant's novel lifting adapter for bulk bags generally by the numeral 10. The lifting adapter 10 is used for raising and lowering large bulk bags 12 with an overhead crane 14 by a plurality of bag lifting loops 16 contained on the bulk bag.

The lifting adapter 10 is formed in the preferred embodiment with a plurality of lifting arms 18 which are fixedly attached by welding to each other and extend outwardly in an X-shaped configuration. At the central portion of the plurality of lifting arms 18 is a lifting means 20 which is utilized to raise the lifting adapter 10 and to lower it as desired.

On each outer end of the lifting arms 18, there is an attached bag loop retaining means, shown generally by the numeral 22. These retaining means contain movable finger means 24 which are used to release the bag lifting loops 16 from the lifting arms at a predetermined time by the pivoting of the finger means downwardly as shown in FIG. 2 of the drawings.

The movable finger means 24 are operated by a pneumatic system in the preferred embodiment which is connected to the pneumatic lines 26 which are operated remotely from the filled large bulk bag 12. The overhead crane 14 then is able to raise the large bulk bag upwardly as shown by the arrow direction 28 in FIG. 1.

Figure 2:
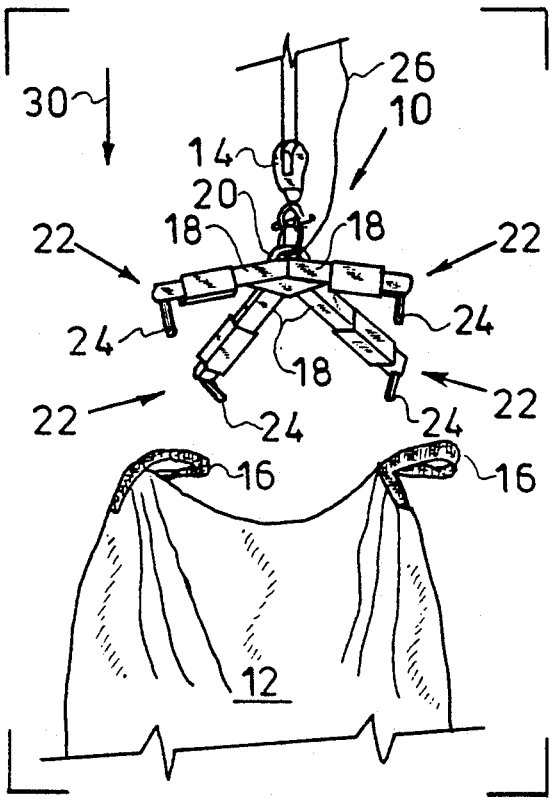
FIG. 2 is an enlarged view of the applicant's lifting adapter showing the adapter releasing a filled bag from the adapter after the bag has been placed at a desired position on top of a similarly filled bag.

Referring now to FIG. 2 of the drawings, there is shown an enlarged view of the Applicant's lifting adapter 10 showing the adapter releasing a filled bag from the adapter after the bag has been placed at a desired position for storage on top of a similarly filled bag or in some remote location.

It can be seen in FIG. 2 how the movable finger means 24 have been rotated downwardly to the position shown which has allowed the large bulk bag 12 to drop off the lifting adapter 10 as the bag lifting loops 16 slide off the moveable finger means of the bag loop retaining means 22 by gravity. In this manner, a large filled bulk bag 12 may be positioned on top of a similarly filled bulk bag. The applicant's device may then be activated through the pneumatic line 26 as will be described later.

The filled bulk bag 12 may then drop a short distance downwardly as shown by the arrow direction 30 in FIG. 2 thereby permitting a stacking of two or more of the large bulk bags 12 on top of each other in a manufacturing environment. As a result, an employee is not required to climb to the top of the upper stacked bag in order to release the bag lifting loops 16 from previously used prior art type lifting devices such as crane hooks and the like.

Figure 3:
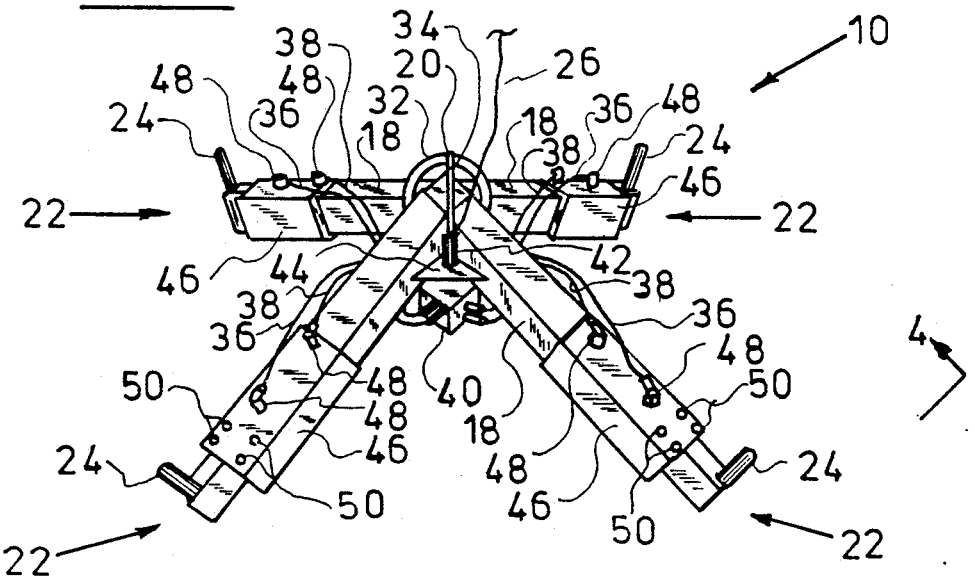
FIG. 3 is a perspective view, taken along lines 3—3 of FIG. 1, showing in detail the four X-shaped lifting arms used in the preferred embodiment as well as showing the various pneumatic lines used in the pneumatic system of the invention.

Referring now to FIG. 3 of the drawings, there is shown a perspective view, taken along lines 3—3 of FIG. 1, showing in detail the four X-shaped lifting arms 18 used in the preferred embodiment. The lifting means 20 is formed with a downwardly positioned U-shaped lifting rod 32 which is welded to the lifting adapter as will be described hereinafter. The lifting means 20 also has welded thereto a pair of partial U-shaped lifting rods 34 positioned as shown in FIG. 3. The lifting means can also be seen in FIGS. 4 and 5 of the drawings.

There can also be seen in FIG. 3, a plurality of pneumatic lines 36 and 38 positioned as shown and terminating in pneumatic elbows 48 which are used to attach the pneumatic lines 36 and 38 to the respective bag loop retaining means 22. The pneumatic lines 36 and 38, for two of the arms, terminate at a pneumatic box connection 40 and are connected to a pneumatic coupling 42 which is positioned vertically upwardly on a gusset 44. The pneumatic lines 36 and 38 for the other two arms also terminate in a similar pneumatic box connection 40 which is not seen in FIG. 3 of the drawings. The before described pneumatic lines 26 are then attached to pneumatic couplings 42 so that the lifting adapter 10 may be controlled from a remote location as will be described hereinafter.

A plurality of tubular sleeves 46 are positioned over the outer ends of the lifting arms 18 and are welded thereto to form a receiving pocket for retaining the bag loop retaining means 22 in the tubular sleeves 46. A plurality of bolts 50 are positioned through the tubular sleeves 46 to rigidly hold the bag loop retaining means 22 in the position shown.

Figure 4:
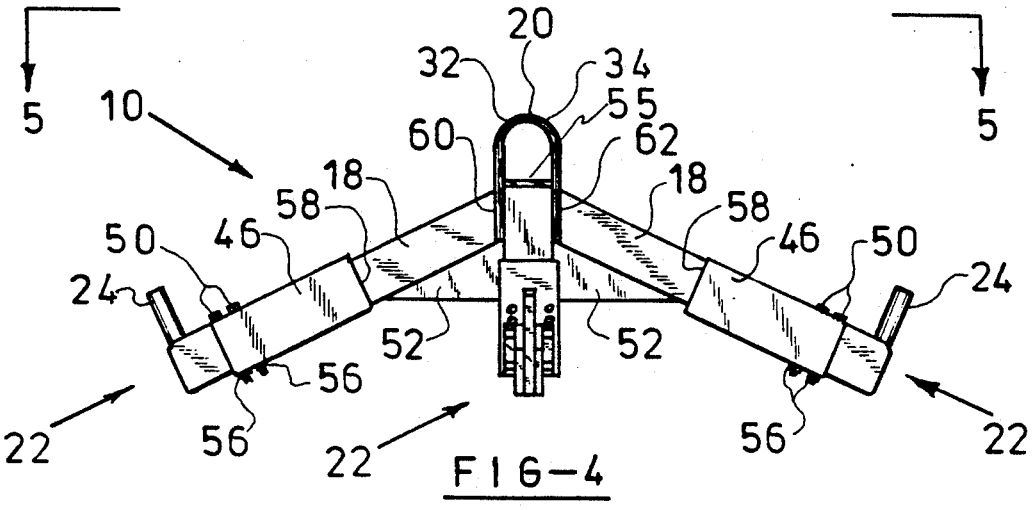
FIG. 4 is a side view, taken along lines 4—4 of FIG. 3, showing the downwardly and outwardly inclined lifting arms used in the preferred embodiment of the invention.
Figure 5:
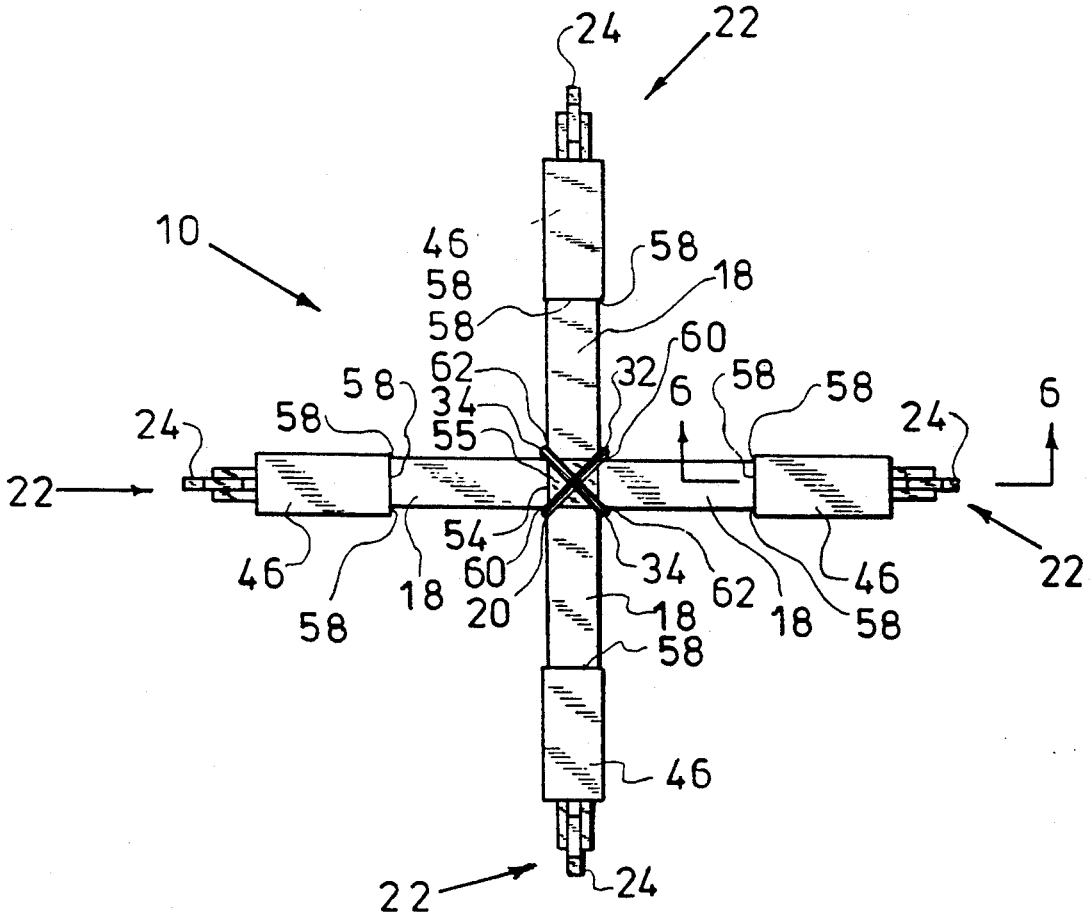
FIG. 5 is a top plan view, taken along lines 5—5 of FIG. 4.
Figure 6:
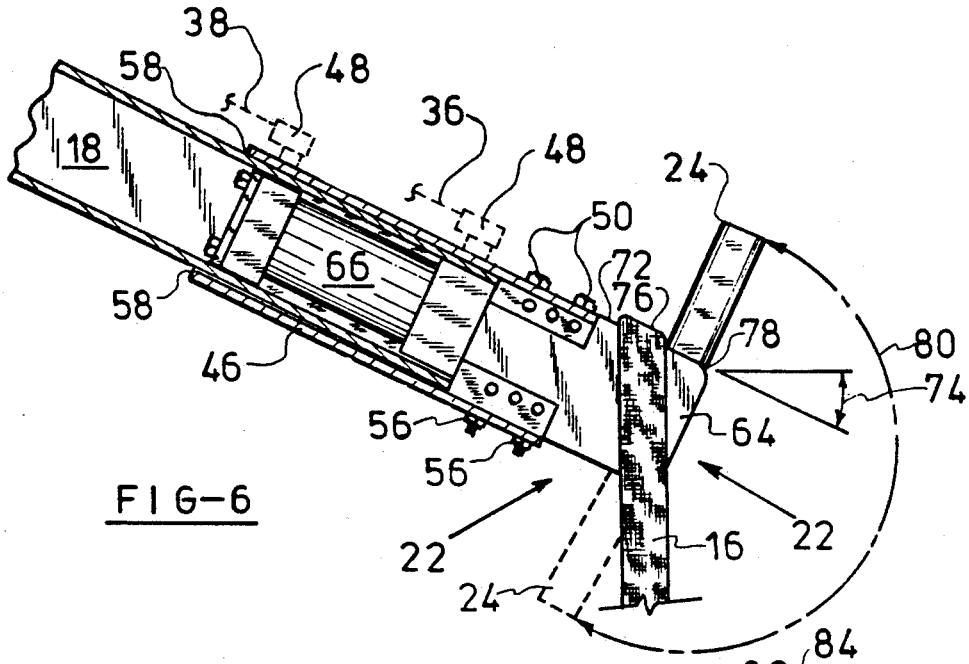
FIG. 6 is a cross sectional view, taken along lines 6—6 of FIG. 5, showing in detail the retraining means and the moveable fingers used in the device which operate to hold and release the filled bag as desired.

Referring now to FIGS. 4–6 of the drawings, there will be described in detail, the positioning of the bag loop retaining means 22 which contain the moveable finger means. For purposes of clarity, the various pneumatic lines 36 and 38 along with the pneumatic connections 42 and 48 and the gussets 44 have not been shown in FIGS. 4 and 5 but are shown in FIG. 6 of the drawings.

Referring now specifically to FIG. 4 of the drawings, there is shown a side view, taken along lines 4–4 of FIG. 3. The lifting arms 18 are shown in the downwardly and outwardly inclined position with the tubular sleeves 46 being shown holding the retaining means 22 within the sleeves 46 by the plurality of bolts 50 and nuts 56. A plurality of reinforcing gussets 52 are welded to the downwardly extending arms 18 at the positions shown in FIG. 4 to further strengthen the lifting adapter 10.

Referring now specifically to FIG. 5 of the drawings, there is shown a top plan view, taken along lines 5—5 of FIG. 4. The lifting means 20 formed with the U-shaped lifting rod 32 and the pair of partial U-shaped lifting rods 34 can be seen more clearly in FIG. 5 at the center of the X-shaped configuration.

At the apex of the X-shaped configuration, there is positioned a downwardly inclined central tubular section 54 to which the lifting arms 18 are welded. Each lifting arm 18 is also welded to the adjacent lifting arm at the apex. A tube cap 55 is positioned on the upper portion of the central tube 54 as shown both in FIGS. 4 and 5 and is welded to the combination.

There can also be seen in FIGS. 4 and 5, the weld 58 which is formed around the upper end of each tubular sleeve 46 to retain the sleeves 46 on the arms 18. It can also be seen in FIG. 5, how the U-shaped lifting rod 32 and partial U-shaped lifting rods 34 are welded at 60 and 62 in the center of the X-shaped configuration of the lifting adapter 10.

Referring now to FIG. 6 of the drawings, there is shown a cross-sectional view, taken along lines 6—6 of FIG. 5, showing in detail, the bag loop retaining means 22 and the movable finger means 24 used in the device. As before described, the movable finger means 24 operate to retain the bag loops on the finger means 24 until released as desired.

The bag loop retaining means 22 comprise, in part, a toggle lock device 64 of the type which is commercially used in industry in a different application than the application used in the Applicant's device. The toggle lock device 64 contains the movable finger means 24 which is operated by a pneumatic cylinder 66 connected to the before described pneumatic lines 36 and 38. The toggle lock device 64 will be further described when referring to FIGS. 7 and 8 of the drawings.

FIG. 6 shows in detail how the toggle lock device 64 is positioned partially inside of the lifting arm 18 and partially inside of the tubular sleeve 46 which is welded to the arm 18. The toggle lock device 64 is retained in the tubular sleeve 46 by the plurality of bolts 50 and nuts 56.

The toggle lock devices 64, positioned in each of the lifting arms 18, have an engaging and sliding surface 72 which engages the top portion 76 of the bag lifting loops 16 as can be seen in FIG. 6 of the drawings. When the finger means 24 of the toggle lock device 64 are in the upward position, as shown in FIG. 6, the top portion 76 of the bag lifting loops 16 is retained. In this position, the bag 12 can not slide off the lifting adapter 10 by the bag weight due to gravity.

This upward position of the finger means 24 retains the large bulk bag 12 in the position shown in FIG. 1 of the drawings on the lifting adapter 10 until it is desired to release the bag from the lifting adapter. When this occurs, the bag lifting loops 16 will slide downwardly along the engaging and sliding surfaces 72 until the bag loops drop off the edge 78 on the toggle lock devices 64.

The angle shown by the numeral 74 of the engaging and sliding surface 72 is approximately twenty five and one-half degrees from the horizontal to insure that the bag 12 used in the preferred embodiment will slide off the engaging and sliding surface 72 by gravity. The slope of the angle 74 may also vary from ten degrees to thirty degrees or more from the horizontal depending upon the particular configuration of the bag 12, the bag loops 16 and size and weight of the bag used as well as the type of material used in the bag loop construction.

There can also be seen in FIG. 6, the pivotal range of the movable finger means 22 of the toggle lock devices 64. This is shown in FIG. 6 by the angle 80. The finger means 24 is shown upwardly positioned in FIG. 6 in a retaining or holding position and is shown downwardly positioned in dashed lines as the numeral 24 in a release position after being pivoted through the angle 80 of FIG. 6.

The toggle lock devices 64, which form the bag loop retaining means 22, used in the preferred embodiment, are manufactured by the DE-STA-CO, a division of Dover Corporation, 350 Midland Avenue, Detroit, Mich. 48203. The devices 64 are commonly used in power clamping applications in various manufacturing processes. They are designed to rigidly clamp products in a fixed position at various manufacturing positions. While rigidly clamped, the product can then be drilled, milled or can have other manufacturing processes performed on the product.

The type of toggle lock devices used by the applicant in his invention are the series 860, shown on the prior art fax copy filed with the subject application. Further details of this device are shown in the manufacturers drawing also filed herein as prior art.

The model, used by the applicant, features a 180 degree clamping arm which travels to an over-centered locked position parallel to the clamp center line. This can be seen in the details on the manufacturer's materials filed as prior art. Each toggle lock device 64 has a 3000 pound holding capacity and can exert a maximum force (at 80 psig) of 1250 pounds when used as a clamp. The pneumatic pressure used in the device can be up to a maximum of 150 psig.

Figure 7:
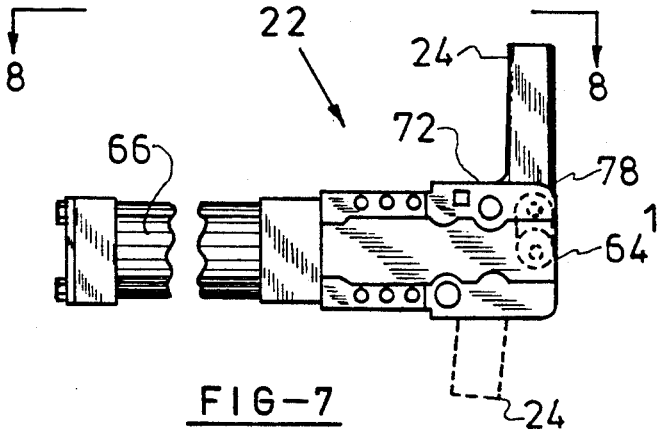
FIG. 7 is a side view of the retaining means shown removed from the lifting arms.
Figure 8:
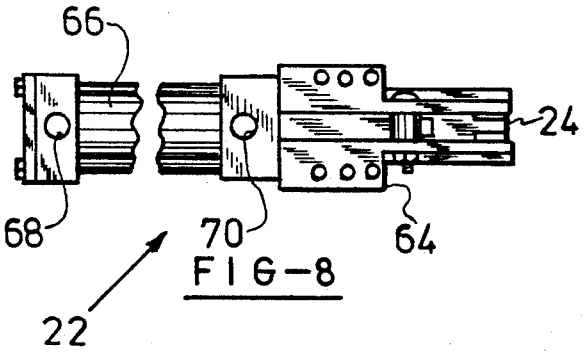
FIG. 8 is a top plan view, taken along lines 8—8 of FIG. 7.

Referring now to FIGS. 7 and 8 of the drawings, there is shown in FIG. 7, a side view of the toggle lock device 64 forming the retaining means 22 used with the lifting arms 18. There is also shown in FIG. 8, a top plan view of the device, taken along lines 8—8 of FIG. 7.

There can be seen in FIG. 7, the engaging and sliding surface 72 as well as the edge 78 of the sliding surface 72 on the toggle lock devices 64. The edge 78 is the edge from which the bag loops 16 of the bag 12 drop when the movable fingers 24 are in the dashed position 24, shown in FIG. 6.

FIG. 8 also shows the pneumatic connections 68 and 70 of the toggle lock device 64 which forms the retaining means 22. These connections 68 and 70 are ⅜ inch NPT threads used for mounting the elbows 48 of the pneumatic lines. While the toggle lock devices 64, manufactured by the DE-STA-CO have been used in the preferred embodiment, other devices may also be used within the spirit and scope of the applicant's invention.

For example, while pneumatic toggle lock devices 64 have been used in the preferred embodiment, it is within the spirit and scope of the applicant's invention that electric devices as well as hydraulic devices may also be used with modifications.

Figure 9:
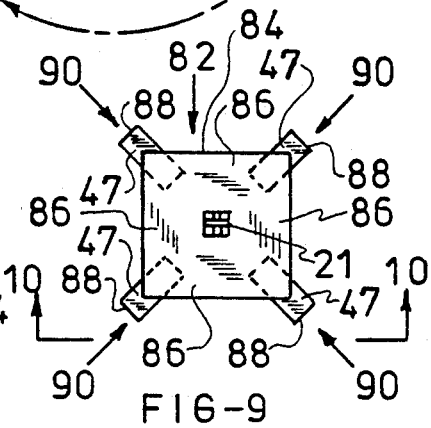
FIG. 9 is a top plan view of a modification of the applicant's novel lifting adapter.

In addition, other configurations for the lifting adapter 10 may be used and are considered to be within the spirit and scope of the applicants'invention. For example, FIG. 9 shows one type of modification of the basic lifting adapter shown generally by the numeral 82. A frame 84 is formed with a plurality of plates 86 which are welded together in the configuration shown and have a centrally placed lifting means 21 which is constructed similarly to the lifting means 20 of the preferred embodiment hereinbefore described.

A plurality of tubular sleeves 47, of the type similar in construction to the tubular sleeves 46 used in the preferred embodiment, are then welded to the underside of the plates 86 in the position shown. These tubular sleeves 47 have outer edges 88 and receive the toggle lock devices 64 which are positioned in the tubular sleeves 47 in the direction by the arrows 90. The toggle lock devices 64 are then bolted to the tubular sleeves as previously described when referring to the preferred embodiment.

Figure 10:
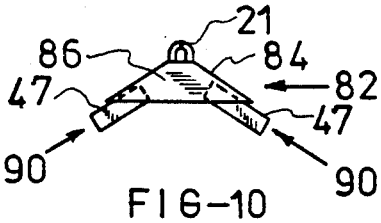
FIG. 10 is a side view, taken along lines 10—10 of FIG. 9.

Referring now to FIG. 10 of the drawings, there is shown a side view, taken along lines 10—10 of FIG. 9, showing in more detail the modified lifting adapter 82. Lifting means 21 are welded to the top of the modified adapter as shown in FIGS. 9 and 10 and would be formed from the U-shaped lifting rod 32 and the partial U-shaped lifting rods 34, similar to the preferred embodiment.

Figure 11:
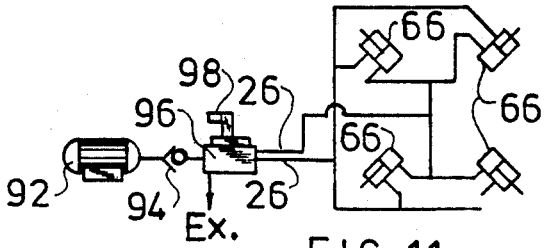
FIG. 11 is a schematic diagram of the control means for controlling the finger movement of the applicant's lifting adapter.

FIG. 11 is a schematic view showing the control means that may be used in the preferred embodiment and in the modified form of the applicant's invention. An air supply 92 may consist of a plant air supply or a stationary air compressor. This is connected by pneumatic lines to a check valve 94 and to a control valve 96.

The control valve 96 has a handle 98 which is used to operate the control valve to control the flow of air to and from the various pneumatic cylinders 66 used in the toggle lock devices 64. The control means are positioned remotely from the lifting adapter 10 and are connected to the lifting adapter by the pair of pneumatic lines 26.

From the foregoing, it can be seen that there has been provided by the subject invention, a new and novel lifting adapter and lifting adapter frame which may be used to lift and release bulk bags from an overhead crane. The lifting and release of the bulk bags is controlled from a remote location as previously described.

It is apparent that modifications and changes may be made in the subject invention and modified forms of the invention within the spirit and scope of the applicant's patent application. The preferred embodiment and modifications shown have been given by way of illustration only and the Applicant is not to be limited to the exact embodiment herein described.

Having described my invention,

I claim:

1. A movable lifting adapter for use in lifting and releasing bulk bags from an overhead crane, the bags having a plurality of attached bag lifting loops which are attached to the bag and carry the weight of the contents of the bag and also remain attached to the bulk bag as the bag is lifted and then subsequently slide off of the lifting adapter is desired, comprising:

a. a frame having outer edges;

b. lifting means, fixedly attached to the frame, for raising and lowering the bulk bag by the overhead crane;

c. bag loop retaining means, fixedly attached to the outer edges of the frame, for retaining the bag loops on the retaining means so that the bulk bag can be raised and then later lowered at a predetermined time, the bag loop retaining means containing a bag loop engaging and sliding surface upon which the bag loops can slide when the bulk bag and the attached bag loops are released by the adapter;

(1) movable finger means, associated with the bag loop retaining means and positioned thereon, for movement between an upwardly extending engaged position to a downwardly extending release position, the finger means serving to hold the bulk bag loops and the weight of the contents of the bag on the engaging and sliding surface of the retaining means whenever the finger means are in an engaged position; and d. control means, associated with the frame and the retaining means and the finger means for controlling the movement of the finger means between an engaged position and a release position so that the attached bag lifting loops may slide along the engaging and sliding surface of the retaining means until the entire bag with the attached bag lifting loops slide off of the engaging and sliding surface and become disengaged from the lifting adapter.

2. The lifting adapter as defined in claim 1 wherein the frame is formed as a plurality of outwardly and downwardly extending arms, each arm being positioned and fixed to other arms at a central location.

3. The lifting adapter as defined in claim 2 wherein the lifting means comprises at least one U-shaped rod fixedly attached to the central location of the plurality of arms.

4. The lifting adapter as defined in claim 2 wherein the plurality of arms are inclined downwardly approximately ten degrees to thirty degrees from a horizontal position.

5. The lifting adapter as defined in claim 1 wherein the bag loop retaining means comprises in part a plurality of toggle lock devices fixedly attached to the outer edges of the frame.

6. The lifting adapter as defined in claim 5 where the toggle lock devices have pivotally mounted thereon the movable finger means.

7. The lifting adapter as defined in claim 6 wherein the toggle lock devices comprise in part a pneumatic cylinder for operation of the movable finger means.

8. The lifting adapter as defined in claim 1 wherein the retaining means are inclined downwardly from a horizontal position approximately twenty five and one half degrees.

9. The lifting adapter as defined in claim 1 wherein the retaining means are inclined downwardly approximately ten degrees to thirty degrees from a horizontal position.

10. The lifting adapter as defined in claim 1 wherein the control means is connected to the lifting adapter at a remote location from the frame and comprises, in part, an air supply, a control valve and related pneumatic lines to control air pressure from the air supply through the pneumatic lines to the lifting adapter.

11. In a lifting adapter which is attached to an overhead crane and is used for raising and lowering large bulk bags of the type having a plurality of bag lifting loops so that the bulk bags can be easily moved and/or stored on top of each other as desired, the improvement comprising:

a. the lifting adapter being formed in a configuration having outwardly positioned attaching areas;

b. a plurality of bag loop retaining means being fixedly attached at the outwardly positioned attaching areas;

(1) each bag loop retaining means having a bag loop engaging and sliding surface formed thereon, the engaging and sliding surface having an end portion thereon;

(2) each retaining means having attached thereto, a pivoting finger means positioned at the end portion of the engaging and sliding surface, the pivoting finger means being pivoted within the end portion of the engaging and sliding surface from a generally upwardly pointing engaged position to a generally downwardly pointing release position, the design of the pivoting finger means serving to hold the bag loops on the engaging and sliding surface of the retaining means when the finger means are in the upwardly pointing engaged position and to later release the bag loops from the engaging and sliding surface at a predetermined time when the finger means have been pivoted to the downwardly pointing release position;

(3) each bag loop engaging and sliding surface on the retaining means being sloped downwardly and outwardly at a predetermined angle to permit the bag loops to disengage from the engaging and sliding surface at a predetermined time by the action of gravity on the bag; and c. means, associated with the lifting adapter and operable remotely from the adapter, to control the pivoting movement of the finger means from the upwardly pointing engaged position to the downwardly pointing release position as desired from a remote location.

12. The improvement as defined in claim 11 wherein the lifting adapter is formed in an X-shape configuration.

13. The improvement as defined in claim 11 wherein the lifting adapter is formed in an X-shape configuration with a plurality of outwardly and downwardly extending arms sloped at a predetermined angle for receiving the bag loop retaining means.

14. The improvement as defined in claim 11 wherein the bag loop engaging and sliding surface is sloped at an angle from horizontal approximately in the range from ten degrees to thirty degrees.

15. The improvement as defined in claim 14 wherein the bag loop engaging and sliding surface is sloped at an angle of approximately twenty-five and a half degrees from horizontal.

* * * * *